US007879196B2

(12) United States Patent
Nilsson et al.

(10) Patent No.: US 7,879,196 B2
(45) Date of Patent: Feb. 1, 2011

(54) TANK ASSEMBLY FOR MAKING FIBRE PRODUCTS FROM STOCK

(75) Inventors: Björn Nilsson, Kimstad (SE); Lars Graffton, Bettna (SE)

(73) Assignee: Pakit International Trading Company Inc., Upton, St. Michael (BB)

( * ) Notice: Subject to any disclaimer, the term of this patent is extended or adjusted under 35 U.S.C. 154(b) by 179 days.

(21) Appl. No.: 12/293,454

(22) PCT Filed: Apr. 27, 2007

(86) PCT No.: PCT/SE2007/050281

§ 371 (c)(1),
(2), (4) Date: Dec. 29, 2008

(87) PCT Pub. No.: WO2007/129972

PCT Pub. Date: Nov. 15, 2007

(65) Prior Publication Data

US 2009/0277599 A1 Nov. 12, 2009

(30) Foreign Application Priority Data

May 5, 2006 (SE) ..... 0601031-8

(51) Int. Cl.
*D21H 23/00* (2006.01)

(52) U.S. Cl. ..... 162/380

(58) Field of Classification Search ..... 162/380
See application file for complete search history.

(56) References Cited

U.S. PATENT DOCUMENTS 3,232,827 A 2/1966 Foote

FOREIGN PATENT DOCUMENTS

EP 1235462 A1 8/2002
WO 9720986 A1 6/1997

*Primary Examiner*—Mark Halpern
(74) *Attorney, Agent, or Firm*—King & Spalding LLP

(57) ABSTRACT

The present invention relates to a tank assembly for making fiber products from stock comprising a stock vat, a main tank (2, 103, 202), at least one inlet (20, 21, 111, 216) to said main tank from said stock vat, and an outlet (22, 113, 217) from said main tank. The tank assembly further comprises at least one mold tank (3, 102, 203, 204) having at least one inlet (37, 114, 218, 219) at its bottom connected to the inlet to said main tank and an outlet (4, 116, 221, 223) connected to said main tank so that stock from the mold tank is arranged to flow into said main tank and in that the horizontal cross-sectional area at the top of said mold tank is larger than the horizontal cross-sectional area at the bottom of said mold tank.

14 Claims, 6 Drawing Sheets

TANK ASSEMBLY FOR MAKING FIBRE PRODUCTS FROM STOCK

This application is a 371 of PCT/SE2007/050281 filed on 27 Apr. 2007.

FIELD OF THE INVENTION

The invention relates to a tank assembly for making fibre products from stock and especially to three-dimensional objects such as egg cartons, and other packaging products and also to objects such as drinking cups for beverages or trays, e.g. food trays. The invention more especially relates to a tank assembly for making fibre products from stock comprising a stock vat, a main tank, at least one inlet to said main tank from said stock vat, and an outlet from said main tank.

BACKGROUND OF THE INVENTION

Fibre products such as for example egg cartons can be made from stock in a process where a fibre layer is created and shaped to a desired form whereby the so shaped fibre product is dewatered and possibly subjected to some form of post-processing operation.

U.S. Pat. No. 6,136,150 discloses a method for producing a flow stock in a mould tank. The moulding tank is used for producing a fibre product such as an egg carton or other packaging products. At least one horizontally extending grating is provided across the tank between the bottom and the brim of said tank. A flow of stock in the mould tank is pumped in at the bottom of the mould tank and is allowed to flow up over the brim of the tank resulting in a flow directed upwards important for forming a fibre layer of even thickness on a male tool which is dipped into said stock. Due to this arrangement stock is easily clogged in the tank at said grating or gratings. There is involved a lot of measures to get rid of such clogged portions of the stock which are both time consuming and expensive.

During production of fibre products such as for example egg boxes and drinking cups, it is desirable that the shape of the final product can be controlled in a reliable way. For many applications, it is also desirable that the final product has substantially even strength properties so that the final product does not bend easier in one direction than in another. If heat is used to dewater the fibre product, it is also desirable that the heat does not burn the surface of the fibre product. It is also desirable that vaporized water can be evacuated efficiently.

It is an object of the present invention to provide a tank assembly of the type defined above which set aside the above problems.

DESCRIPTION OF THE INVENTION

The object is achieved with a tank assembly further comprises at least one mould tank having at least one inlet at its bottom connected to the inlet to said main tank and an outlet connected to said main tank so that stock from the mould tank is arranged to flow into said main tank and in that the horizontal cross-sectional area at the top of said mould tank is larger than the horizontal cross-sectional area at the bottom of said mould tank.

DESCRIPTION OF THE DRAWINGS

Preferred embodiments of the present invention will now be described, by way of examples only, with reference to the accompanying drawings, which show.

DETAILED DESCRIPTION OF THE INVENTION

Figure 1:
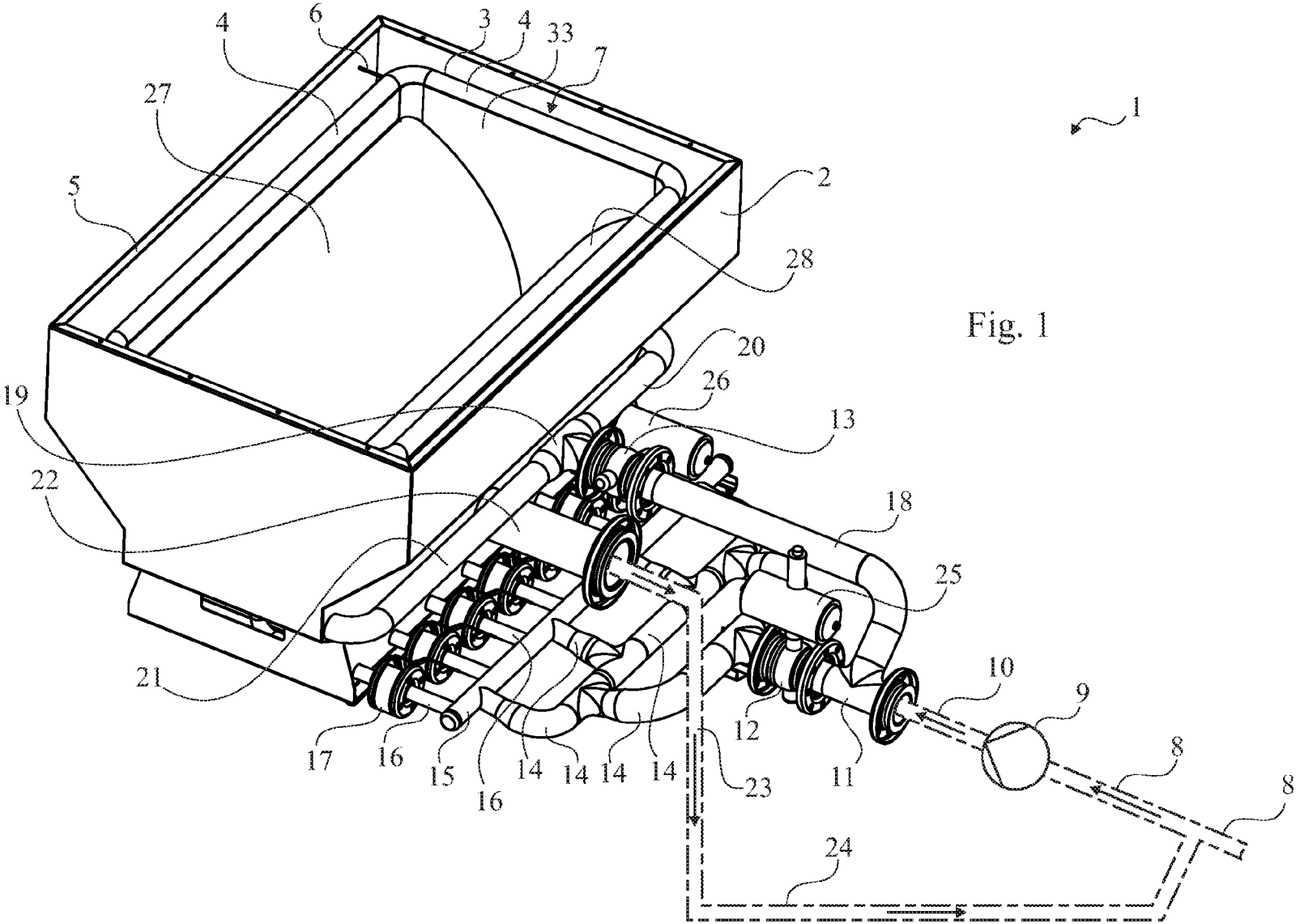
FIG. 1 is a perspective view of a tank assembly according to the invention.
Figure 2:
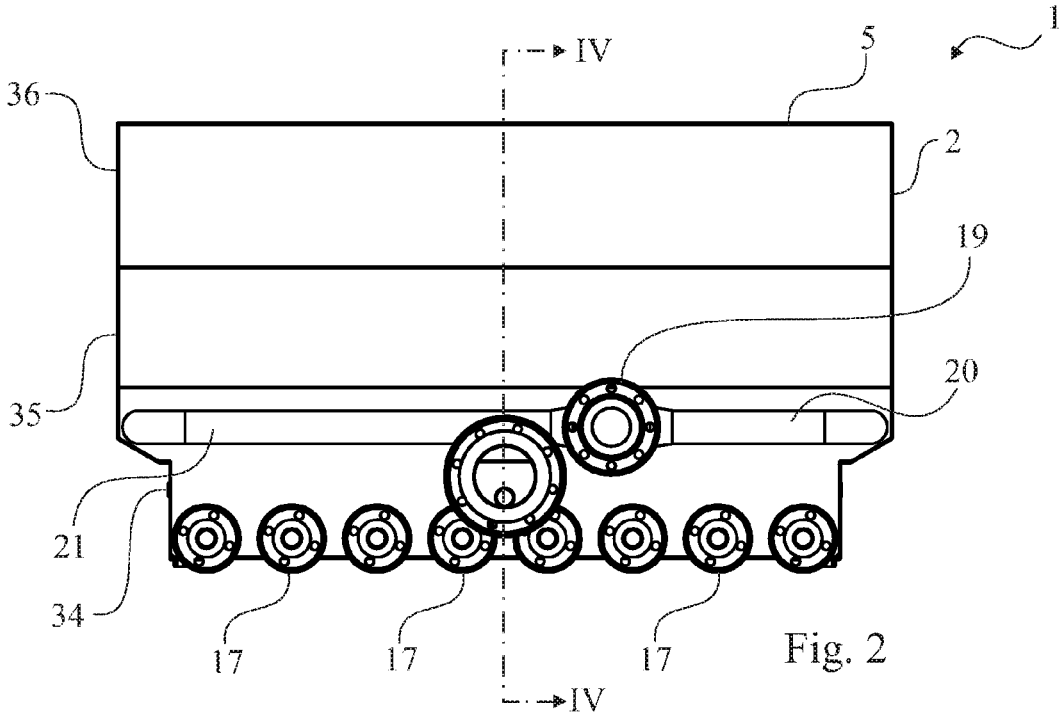
FIG. 2 is a side view of the tank assembly.
Figure 3:
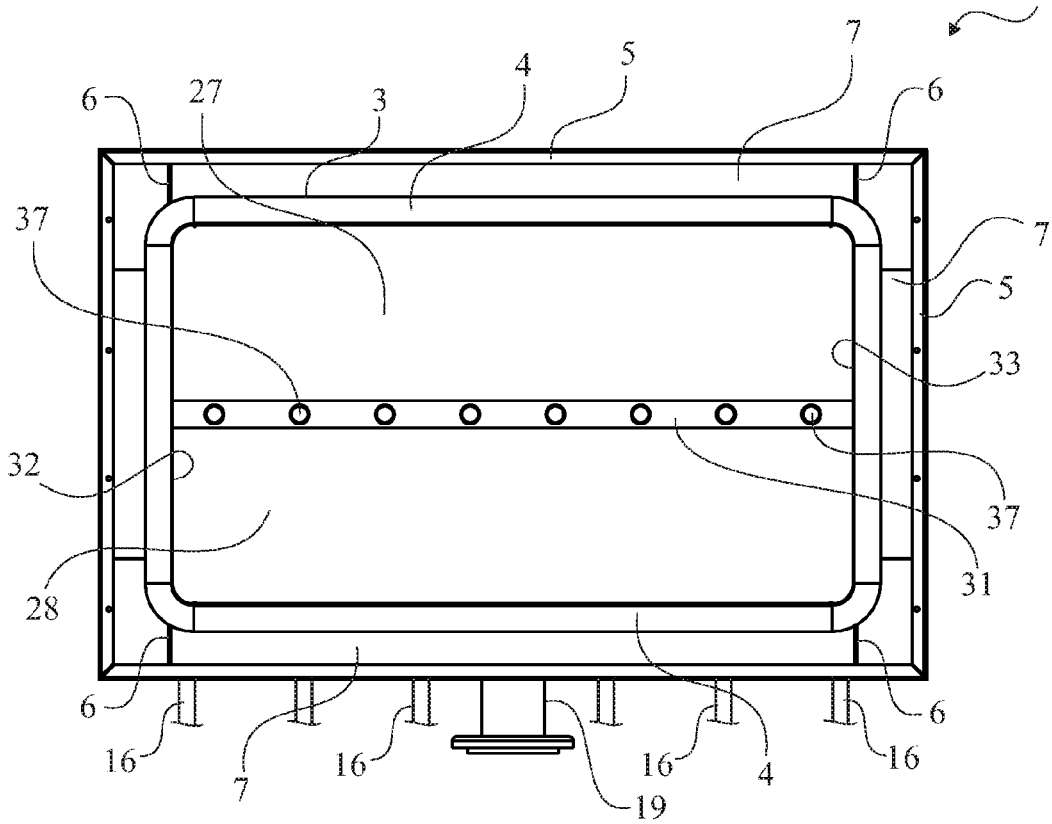
FIG. 3 is a plan view of the tank assembly, whereby the inlet conduits in FIG. 2 are deleted.

In FIGS. 1-6 a first embodiment of tank assembly 1 according to the invention is shown. The tank assembly comprises a main tank 2 and a mould tank 3 arranged inside the main tank 2. A brim 4 of the mould tank 3 is situated under the upper rim 5 of the main tank 2. Struts 6 are attached between the main tank 2 and the mould tank 3 at the comers thereof to stabilise the mould tank in the main tank and to provide a space 7 between the main tank 2 and the mould tank 3. Stock is pumped through a conduit 8 from a stock vat (not shown) by means of a pump 9 and thereafter through a conduit 10 to a free-way connection 11. From the free-way connection 11 stock can be pumped either through a valve 12 to the mould tank 3 or through a valve 13 to the main tank 2. From valve 12 stock is distributed through a set of conduits 14 to a collecting conduit 15, from which stock is pumped to the mould tank 3 through eight conduits 16 having each a valve 17 and being arranged on predetermined distances from each other. The valves 17 are provided to control the distribution of stock so that the amount of stock to be pumped in at the bottom of the mould tank 3 can be varied. Under certain circumstances it can be advantageously to pump in stock non-uniformly along the bottom of the mould tank. The stock, which is pumped through the conduits 16, flows into the mould tank 3 via inlet apertures 37 (see FIG. 3). Stock pumped through the valve 13 flows through a conduit 18 from the three-way connection 11 and via a three-way connection 19 to the opposite ends of the main tank 2 through conduits 20 and 21. From the main tank 2 stock flows out through an outlet conduit 22 and via schematically shown conduits 23 and 24 to be connected to the conduit 8 before the pump 9 in the flow direction from the stock vat. Valve controls 25 and 26 are provided at the valves 12 and 13, respectively, to control the opening and closing of said valves, which will be described in detail below.

Figure 4:
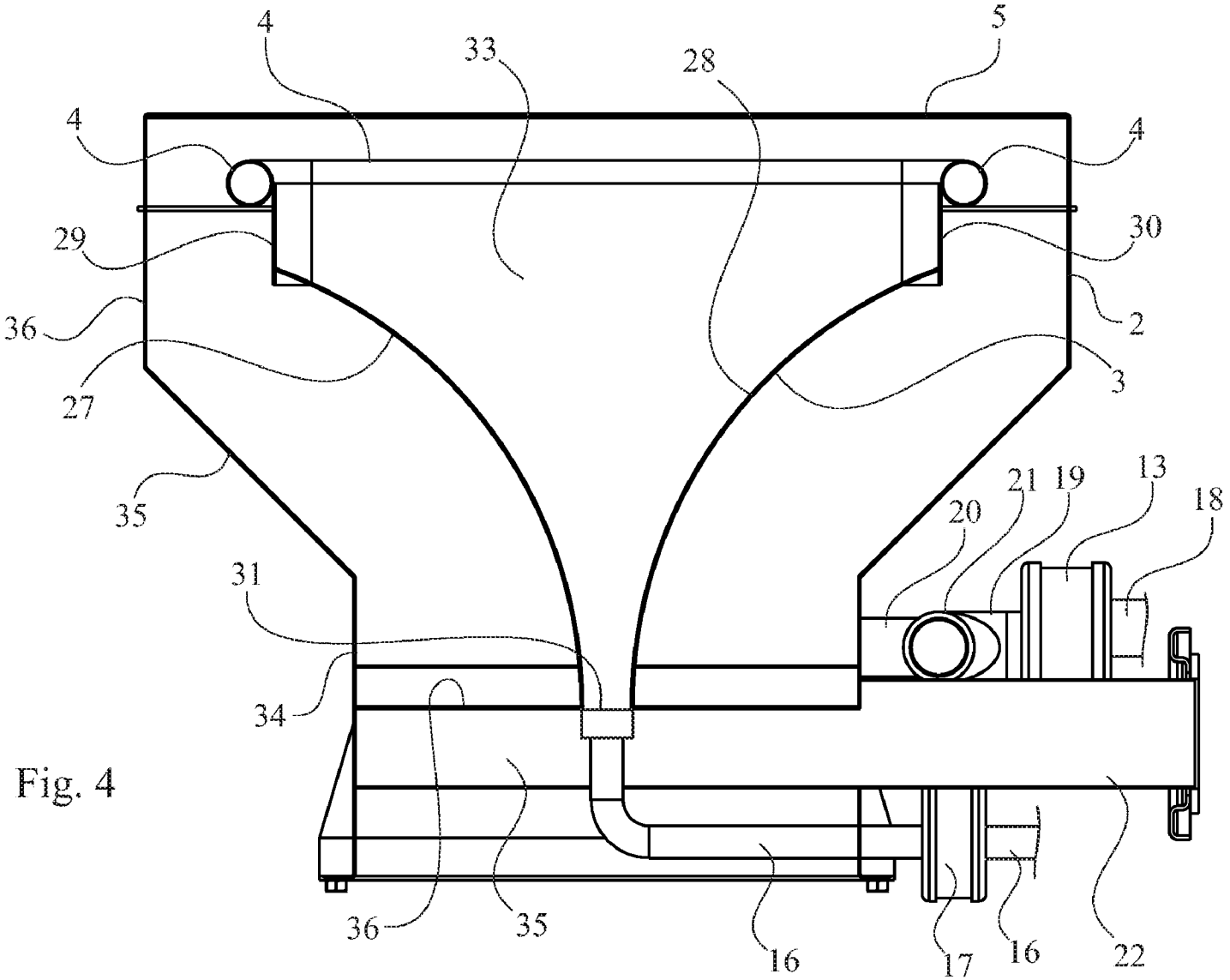
FIG. 4 is a cross-sectional view of the tank assembly along the lines IV-IV in FIG. 2.
Figure 5:
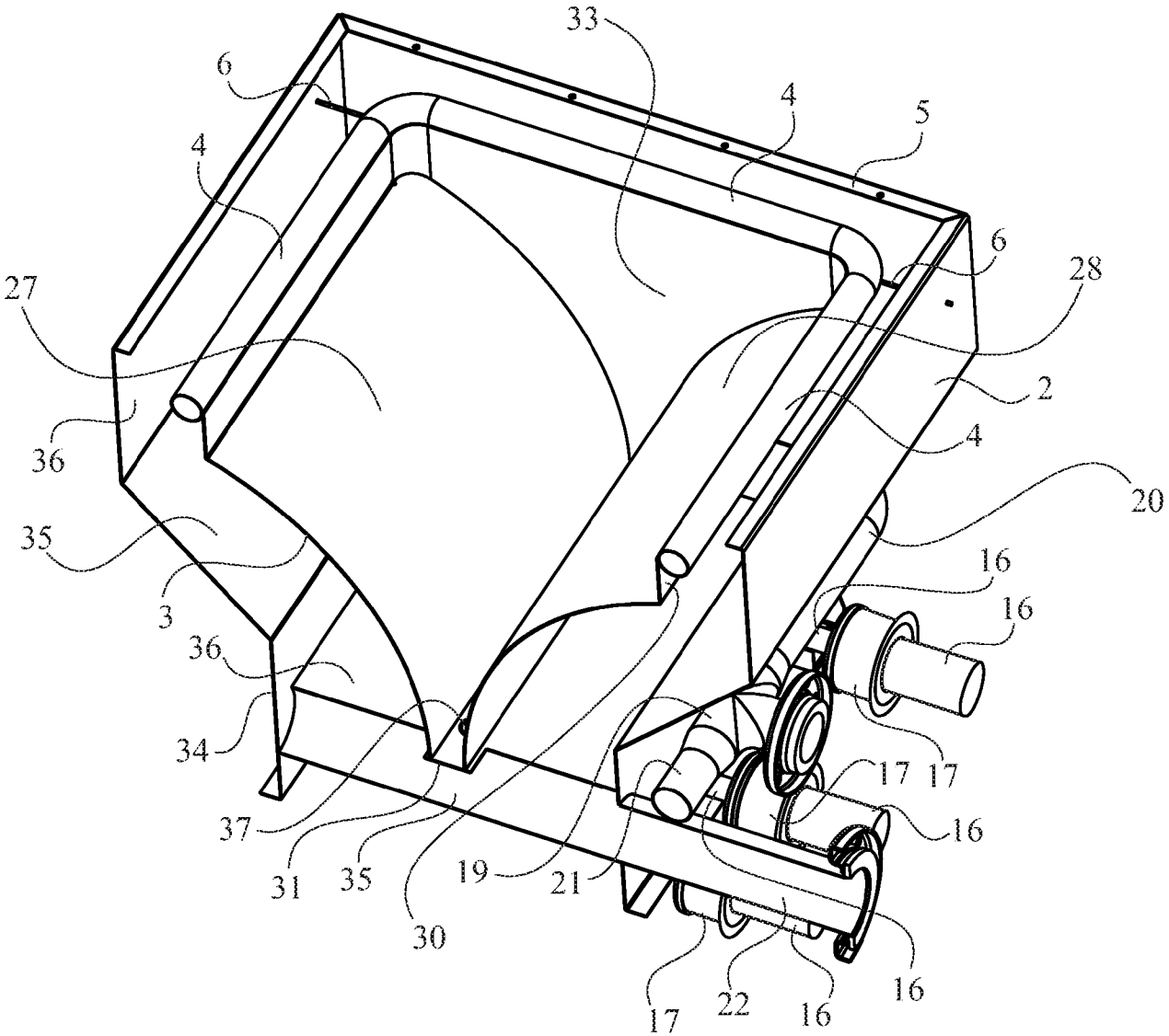
FIG. 5 is a perspective view of the tank assembly as shown in FIG. 4.

In FIGS. 4 and 5 cross-sectional views are shown of the tank assembly. Especially in FIGS. 4 and 5 it is evident that the opposite inner walls 27 and 28 of the mould tank 3 are curved and diverging from the bottom to the top of the tank, where the inner walls 27, 28 continues in vertical portions 29 and 30, respectively, which are connected to the brim 4 of the mould tank 3. The eight inlet apertures 37 (see FIG. 3) are arranged at and spread out along the bottom 31 of the mould tank 3. The opposite inner walls 32 and 33 at the end of the mould tank 3 consist of substantially vertical planes and are connected to the inner walls 27 and 28 to form a trough.

As will be seen from FIG. 4, the main tank 2 consists of a lower section 34 which has substantially vertical walls, a middle section 35 which has along the side upwardly diverging walls, and an upper section 36 which has substantially vertical walls, whereby the cross-sectional area of the upper section 36 is greater than the cross-sectional area of the lower section 34.

The return flow of stock flows down in the prolongation 35 of the conduit 22 incorporated in the bottom 35 of the main tank 2.

Figure 6:
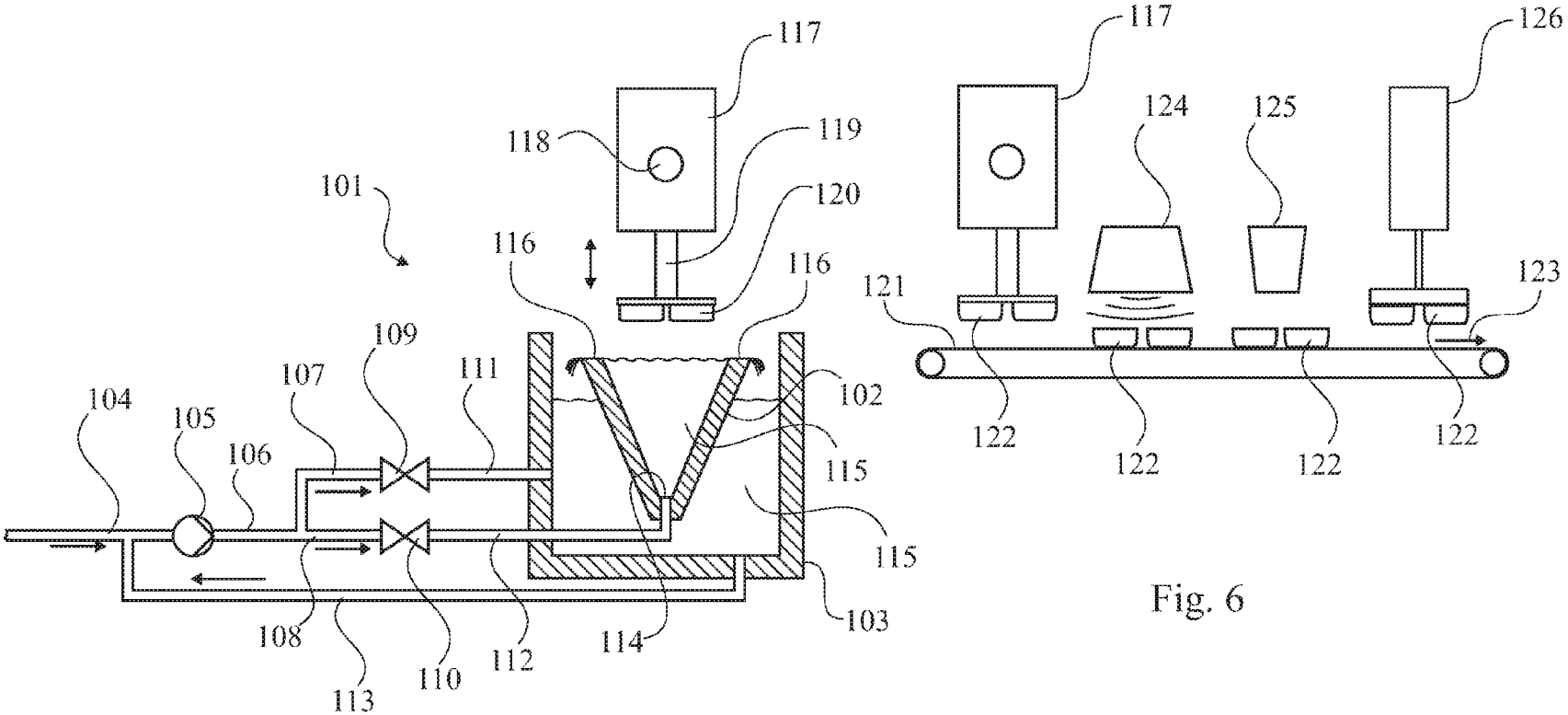
FIG. 6 is a fragmentary diagrammatic view of a first embodiment of the tank assembly.
Figure 7:
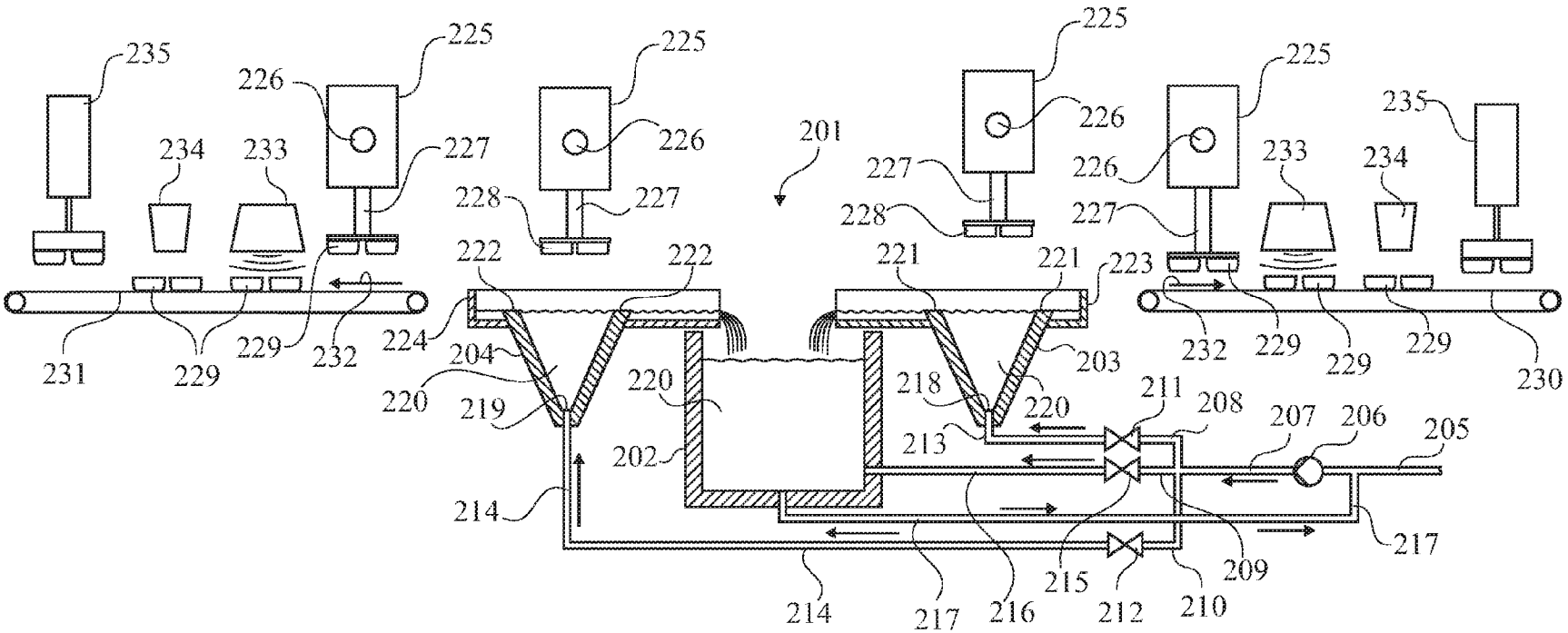
FIG. 7 is a fragmentary diagrammatic view of a second embodiment of the tank assembly.

The function of the tank assembly 1 according to the invention will now be described with reference to FIGS. 6 and 7 showing fragmentary diagrammatically views of two embodiments of the invention.

The tank assembly 101 according to the invention shown in FIG. 6 corresponds substantially to the first embodiment shown in FIGS. 1-5 having a mould tank 102 arranged inside a main tank 103. The tank assembly 101 comprises a conduit 104 in which stock is pumped by means of a pump 105 from a stock vat (not shown). The stock is pumped further through a conduit 106 which by means of a three-way connection is divided into two conduits 107 and 108. Thereafter, stock is pumped through valves 109 and 110 and through conduits 111 and 112 to the main tank 103 and a mould tank 102, respectively. Stock is transported back from the main tank 103 through a conduit 113 to the conduit 114 before the pump 105 in the flow direction from the stock vat. As is evident from FIG. 6, stock is pumped through conduit 112 into the mould tank 102 at the bottom thereof through at least one aperture 114. Stock 115 is then transported upwards to the brim 116 of the mould tank 102 where it flows over the brim 116 and down in the main tank 103. Due to the upwardly diverging form of the mould tank 102 the flow rate of stock 115 at the top of the mould tank 102 is near zero or equal to zero. A pick up unit 117 with a suction device (not shown) is suspended on a turnable pivot axis 118 and has a tool carrier 119. The tool carrier 119 is provided with a number of tools 120 which are arranged to be dipped down in stock 115 in the mould tank 102 to form an embryonic fibre product on the tool surface by means of said suction device. Thereafter, the pick up unit 117 is moved to a conveyor belt 121 where the fibre products 122 are transported and placed directly upon the conveyor belt in the direction of an arrow 123. Of course the fibre product 122 on the tool surface could be subjected to a number of hot and/or cool presses by pressing the tools 120 against a not shown corresponding female tool before the fibre product 122 is placed on the conveyor belt 121, in fact the fibre product 122 could be transported by pivoting the pick up unit 117 and hand over the fibre product 122 in a pressing step to another pick up unit having female tools, which later can hand over/transfer the fibre product 122 to a further pick up unit having male tools 120 etc. The conveyor belt 121 transports the fibre products 122 through a predetermined number of treatments stations as for example a microwave heating device 124 and a marking device 125. Thereafter a robot device 126 lifts the finished manufactured fibre products and brings them to a packaging station for further distribution.

In FIG. 7 a second embodiment showing another type of a tank assembly 201 having one main tank 202 and two mould tanks 203 and 204 situated outside the main tank 202. The stock is pumped from a vat stock (not shown) through a conduit 205 by means of a pump 206 and further through a conduit 207 which by means of a four-way connection is divided into three conduits 208, 209 and 210, whereby stock is transported through the conduits 208 and 210 via valves 211 and 212 and further via conduits 213 and 214 to the mould tanks 203 and 204, respectively. Stock is also transported through the conduit 209 via valve 215 and a conduit 216 to the main tank 202. Stock is transported back from the main tank 202 through a conduit 217 to the conduit 205 before the pump 206 in the flow direction from the stock vat. As is evident from FIG. 7, stock is pumped through conduits 208 and 210 into the mould tanks 203 and 204, respectively, at the bottoms thereof through at least one aperture 218 and 219. Stock 220 is then transported upwards to the brims 221 and 222 of the mould tanks 203 and 204, respectively, where it flows over the brims 221 and 222 and via collection chutes 223 and 224 down in the main tank 202. Due to the upwardly diverging form of the mould tanks 203 and 204 the flow rates of stock 220 at the top of the mould tanks 203 and 204 are near zero or equal to zero. Pick up units 225 each having a suction device (not shown) are turnable suspended on pivot axis 226 and has a tool carrier 227. The tools 228 are arranged to be dipped into stock 220 in the mould tanks 203 and 204, whereas embryonic fibre products 229 are formed on the tools 228 and transported by means of said pick up units 225 to conveyor belts 230 and 231 or on supports (not shown) on the conveyor belt in the directions of arrows 232 through treatment stations, such as microwave heating devices 233 and marking devices 234, to the end of the conveyor belts 230 and 231, where robot devices 235 pick up the finished fibre products for transport to packaging stations for further distribution.

The loop flow arranged through the main tank 2 in FIGS. 1-6 and comprising the pump 9 and the conduits 10, 11, 18, 19, 20, 21, 22, 23, 24, 8 is provided to keep a circulation in the main tank 2 even when the mould tank 3 is being filled up for moulding to prevent from clogging of stock. The valves 12 and 17 can be controlled in such a way that said loop continuously occurs or it can be stopped for a certain reason. The loop flow is accordingly independent of the operation of pumping in new stock into the mould tank 3 by means of controlling the valve 12. Since water is removed from stock when dipping the tools in the mould tank (see FIGS. 6 and 7) it is important to pump new stock from the stock vat into the mould tank to achieve a predetermined concentration of water in the mould tank. This can be obtained by supplying water to the conduit 8 from the stock vat depending on the consumed water in the moulding process in the mould tank 3. The above described loop flow is arranged in the same way in the fragmentary diagrammatic views of two embodiments of the process as shown in FIGS. 6 and 7. In FIG. 6 the loop flowing through the main tank 103 comprises pump 105 and conduits 106, 107, 111, 113, 104. In FIG. 7 the loop flowing through the main tank 202 comprises pump 206 and conduits 207, 209, 216, 217, 205.

In the drawings one main tank and one or two mould tanks are shown in the different embodiments. Of course another number of tanks can be chosen suitably for the process in question. The upwardly diverging form of the mould tank shown in the drawings is not limiting the scoop of the invention. However, the main point is that the horizontal section area at the top of the mould tank is larger than the horizontal section area at the bottom of the mould tank. The horizontal section area at the top of the mould tank is at least twice as large as the horizontal section area at the bottom of the mould tank. The diverging form of the mould tank can be dependent on the flow into the mould tank. If the flow is totally stopped when the moulding operation takes place, it is not necessary to provide the horizontal section area at the top of the mould tank much larger than the horizontal section area at the bottom of the mould tank. When a diminished flow is allowed through the mould tank during the moulding operation, the horizontal section area at the top of the mould tank accordingly must be much larger than the horizontal section area at the bottom of the mould tank. The pick up units in FIGS. 6 and 7 can be more than one as shown to make the process more rapid and effective. The inlet apertures 37 at the bottom 31 of the mould tank can be varied within the scoop of the claims.

The invention can be modified further within the scoop of the appended claims.

The invention claimed is:

1. A tank assembly for making fibre products from stock comprising:

a stock vat;

a main tank;

at least one inlet to said main tank from said stock vat;

an outlet from said main tank; and at least one mould tank having at least one inlet at its bottom connected to the inlet to said main tank and an outlet consisting essentially of the upper brim thereof and connected to said main tank so that stock from the mould tank is arranged to flow into said main tank from said brim and in that the horizontal cross-sectional area at the top of said mould tank is larger than the horizontal cross-sectional area at the bottom of said mould tank, so that the stock entering said mould tank and flowing towards the top thereof having a flow rate near zero or equal to zero at the top of said mould tank.

2. Tank assembly according to claim 1, wherein said stock vat is arranged to supply stock to said mould tank through a conduit and that there is also by-pass conduits that can be used selectively such that stock from said stock vat can be either passed directly to the mould tank or pumped around in a looped flow through said main tank or both simultaneously.

3. Tank assembly according to claim 2, wherein stock, when being pumped around in said looped flow, is pumped to said main tank and further back to the inlet conduit of the tank assembly.

4. Tank assembly according to claim 3, wherein the mould tank has at least one inner wall with a diverging form increasing towards the top so that the inner wall of the mould tank describing a curve which is convex at the inside, whereby the horizontal cross-sectional area of said mould tank increases towards the top, the stock entering said mould tank and flowing towards the top thereof having a flow rate near zero or equal to zero at the top of said mould tank.

5. Tank assembly according to claim 3, wherein the mould tank has at least one inner wall with a diverging form increasing towards the top so that the inner wall of the mould tank describes a substantially straight plane, whereby the horizontal cross-sectional area of said mould tank increases towards the top, the stock entering said mould tank and flowing towards the top thereof having a flow rate near zero or equal to zero at the top of said mould tank.

6. Tank assembly according to claim 2, wherein the mould tank has at least one inner wall with a diverging form increasing towards the top so that the inner wall of the mould tank describing a curve which is convex at the inside, whereby the horizontal cross-sectional area of said mould tank increases towards the top, the stock entering said mould tank and flowing towards the top thereof having a flow rate near zero or equal to zero at the top of said mould tank.

7. Tank assembly according to claim 2, wherein the mould tank has at least one inner wall with a diverging form increasing towards the top so that the inner wall of the mould tank describes a substantially straight plane, whereby the horizontal cross-sectional area of said mould tank increases towards the top, the stock entering said mould tank and flowing towards the top thereof having a flow rate near zero or equal to zero at the top of said mould tank.

8. Tank assembly according to claim 1, wherein the mould tank has at least one inner wall with a diverging form increasing towards the top so that the inner wall of the mould tank describing a curve which is convex at the inside, whereby the horizontal cross-sectional area of said mould tank increases towards the top, the stock entering said mould tank and flowing towards the top thereof having a flow rate near zero or equal to zero at the top of said mould tank.

9. Tank assembly according to claim 8, wherein said mould tank has two opposite inner walls diverging towards the top thereof and in that the other two opposing inner walls are substantially vertical.

10. Tank assembly according to claim 1, wherein the mould tank has at least one inner wall with a diverging form increasing towards the top so that the inner wall of the mould tank describes a substantially straight plane, whereby the horizontal cross-sectional area of said mould tank increases towards the top, the stock entering said mould tank and flowing towards the top thereof having a flow rate near zero or equal to zero at the top of said mould tank.

11. Tank assembly according to claim 1, wherein said mould tank is connected to said main tank in such a way that stock pumped upwards in the mould tank is arranged to flow into said main tank and thereafter flows in a loop back to said main tank.

12. Tank assembly according to claim 11, wherein said mould tank has a brim over which stock is arranged to flow into said main tank.

13. Tank assembly according to claim 1, wherein said mould tank is situated inside said main tank.

14. Tank assembly according claim 1, wherein said mould tank is situated outside said main tank.

* * * * *